United States Patent [19]

Spinning

[11] Patent Number: 4,532,714

[45] Date of Patent: Aug. 6, 1985

[54] ADJUSTABLE RADIAL CURVE

[76] Inventor: Richard R. Spinning, 8960 NW. 8th St., #207, Miami, Fla. 33172

[21] Appl. No.: 525,207

[22] Filed: Aug. 22, 1983

Related U.S. Application Data

[63] Continuation of Ser. No. 454,527, Dec. 30, 1982, abandoned.

[51] Int. Cl.[3] ..... B43L 13/20

[52] U.S. Cl. ..... 33/177

[58] Field of Search ..... 33/27 R, 27 F, 177, 33/178 R

[56] References Cited

U.S. PATENT DOCUMENTS

| | | | |
|---|---|---|---|
| 1,887,391 | 11/1932 | Aras | 33/177 |
| 1,893,690 | 1/1933 | Weston | 33/177 |
| 2,001,949 | 5/1935 | Weston | 33/177 |

FOREIGN PATENT DOCUMENTS

| | | | |
|---|---|---|---|
| 219330 | 2/1910 | Fed. Rep. of Germany | 33/177 |
| 964643 | 5/1957 | Fed. Rep. of Germany | 33/177 |

*Primary Examiner*—Richard R. Stearns
*Attorney, Agent, or Firm*—Sughrue, Mion, Zinn, Macpeak, and Seas

[57] ABSTRACT

An adjustable radial curve is provided having an end tangent bar to which there is attached an assemblage of stacked elements. The stacked elements are fastened together by pin assemblies so that they move independently of each other. The stacked elements are attached to the tangent bar and are adjustable relative thereto. A ruling edge is attached to the stacked elements for creating a curve upon manipulation of the stacked elements. A barscale is attached to the tangent bar and to the stacked elements so that the user of the instrument may set or determine the exact radius of a curve created by the instrument. The barscale may be removable by the provision of a locking device which would function to lock the ruling edge to the ruling arm assembly. A base having at least one guideway is provided for the radial curve whereby radii of particular dimensions may be constructed. A transparent cover is provided for the base.

21 Claims, 22 Drawing Figures

ADJUSTABLE RADIAL CURVECROSS REFERENCE

This is a continuation-in-part of U.S. application Ser. No. 454,527, filed on 12-30-82, and now abandoned.

BACKGROUND OF THE INVENTION

1. Field of the Invention

This invention pertains to an adjustable radial curve instrument for use as an aid in engineering and construction layout and design. The instrument is particularly useful in making curves of any radius. Artists and craftsmen will find this instrument helpful in constructing designs involving circles. The instrument is also useful in the aircraft and ship building industries as well as forming work on construction projects. Instructors will find this instrument to be versatile and useful in instructing students. Handymen will find a variety of uses for this instrument for home and outdoor projects. Even children will enjoy its versatility in constructing circles of any radius.

The instrument may be constructed in various sizes to accommodate projects of all sizes. The instrument components are precisely dimensioned and assembled such that the ruling edge provides extreme accuracy.

The adjustable radial curve is 100 percent accurate throughout its entire length. It is constructed using the principals of chord deflections and radial lines. 2. Statement of the Prior Art Adjustable curved rulers or scribers are well-known. One such device is described in U.S. Pat. No. 2,798,299. This patent discloses an adjustable curve having a plurality of cylindrical weights attached together by a series of linkages. A flexible metal band is attached to the cylindrical weights in such a fashion that permits it to bend in a curve upon manipulation of the various weights. Another curved ruler is disclosed in U.S. Pat. No. 1,893,690. This tool comprises a flexible body formed of strips or ribbons of steel to which there is attached a flexible ruling edge. On the other hand, the present invention is a lightweight instrument formed of superimposed chords and braces and radial arms connected together by suitable pins so as to permit them to rotate and deflect dependently of each other. A ruling edge is attached in a manner to allow it to bend or flex upon adjustment of the assemblage. A bar scale is pivotably attached at one point to the supporting tangent bar and at the other end to the diagonal braces and radial arms. The other end of the bar scales is slidable through a glideway attached to another point on the tool.

Representative of the prior art, in addition to the above patents, are the following patents.

| Patentee | U.S. Pat. No. | Issue Date |
|---|---|---|
| Riegal | 20,121 | Oct. 29, 1863 |
| Wollenhaupt | 219,330 | Feb. 21, 1910 |
| P. A. Gagarin | 677,349 | July 2, 1901 |
| A. Gran J. H. Karlson | 989,547 | Apr. 11, 1911 |
| W. S. Weston | 1,061,345 | May 13, 1913 |
| A. E. Hegardt | 1,313,482 | Aug. 19, 1919 |
| G. J. Nies | 1,380,240 | May 31, 1921 |
| K. Schmieder | 1,797,842 | Mar. 24, 1931 |
| W. S. Weston | 1,893,690 | Jan. 10, 1933 |
| F. D. Hinckelmann | 1,900,500 | Mar. 7, 1933 |
| F. D. Cooper | 2,798,299 | July 9, 1957 |
| J. E. Hoyle | 3,134,176 | May 26, 1964 |
| Toshio Yoshioka | 3,388,475 | June 18, 1968 |

-continued

| Patentee | U.S. Pat. No. | Issue Date |
|---|---|---|
| Debeaux | 3,781,995 | Jan. 1, 1974 |

SUMMARY OF THE INVENTION

This invention is designed to provide a novel adjustable radial curve instrument which can be manufactured at low cost and assembled in various sizes to meet the demands of draftsman engineers construction personnel, craftsmen and laymen in performing or solving a variety of problems involving curves of any radius.

Another object of this invention is to provide a instrument formed of stacked components comprising radial arms, long chords, diagonal braces and brace chords all of which are attached by suitable pin assemblies such as to permit free movement of the components as they dependently rotate about each other.

Yet another object of this invention is to construct a instrument having a flexible ruling edge connected to the ends of the radial arms and diagonal braces such that a curve or any radius may be formed upon adjustment of the stacked components.

And still another object of this invention is to provide a instrument having a removable bar scale adjustably attached to the tool so as to permit the user to set or determine the radius of any given curve.

Still another object of this invention is to provide a instrument having stacked adjustable components, at least one flexible ruling edge attached to the stacked adjustable components, and a base support for the instrument.

And still another object of this invention is to provide a drafting instrument with means to secure one end of the instrument to said support and guideway means for the opposite end thereof.

Another object of the invention is to provide the base with at least one guideway and scale for routing the tool. A transparent cover is provided for the base whereby the instrument may be viewed while on store shelves.

And yet another object of this invention is to provide an adjustable radial curve comprising stacked interconnected elements bendible to form an arc, a ruling edge attached to the elements and a scale for determining a given arc.

Other objects of this invention will become apparent from a reading of the specification when considered in light of the annexed drawings.

BRIEF DESCRIPTION OF THE DRAWINGS

FIGS. 1–8 also show an end tangent bar to which the assembled components are attached.

DETAILED DESCRIPTION OF THE PREFERRED EMBODIMENT

Figure 1:
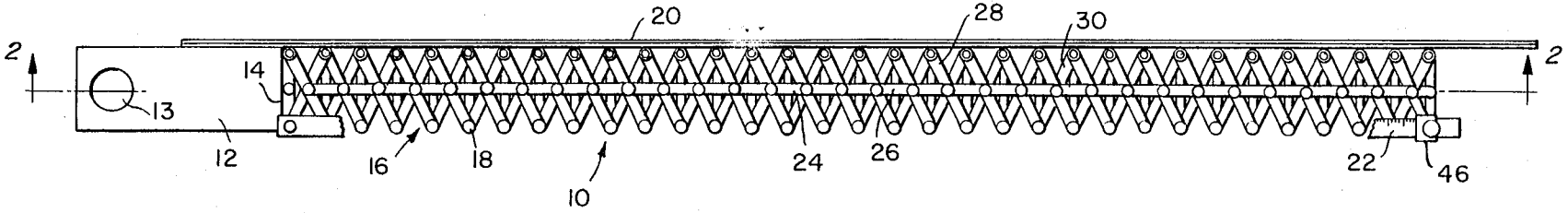
FIG. 1 is a plan view of the invention fully assembled.

Referring in more detail to the drawings, in FIG. 1 there is shown an adjustable radial curve 10 comprising a supporting tangent bar 12 having an aperture 13 therein, a tangent end radial arm 14, a plurality of stacked elements 16 linked together by suitable pin assemblies 18 (one shown here), a ruling edge 20 and a bar scale 22.

Figure 2:
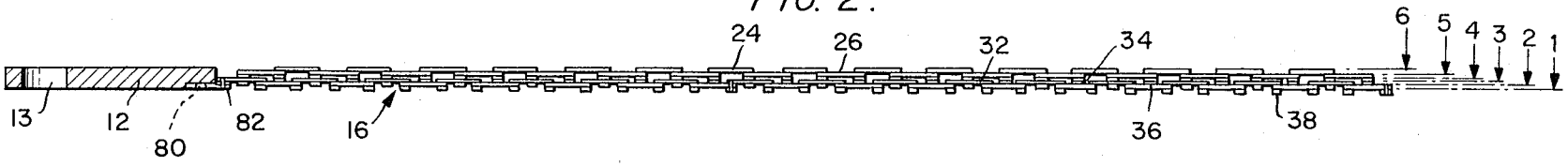
FIG. 2 is a longitudinal view of the invention taken along the line 2—2 of FIG. 1.

A side view of the instant invention is shown in FIG. 2 wherein the stacked elements 16 comprise sixth level brace chords 24, fifth level brace chords 26 underlapping the brace chords 24, fourth level diagonal braces 28, FIG. 1, third level diagonal braces 30, FIG. 1, third level long chords 32, FIG. 2, second level diagonal braces 34 below the third level diagonal braces 30, second level long chords 36 and first level radial arms 38. The six levels are shown at the right end of the structure as seen in FIG. 2. The stacked elements are connected together in various sets for rotation independently of each other. These connections will be described below.

Figure 3:
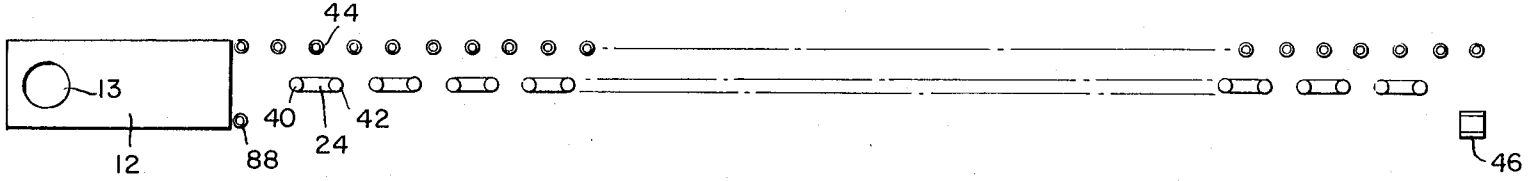
FIG. 3 is a plan view of the invention showing the sixth level assembly of upper brace chords, ruling edge attachment dowels and a guieway for the bar scale.
Figure 4:
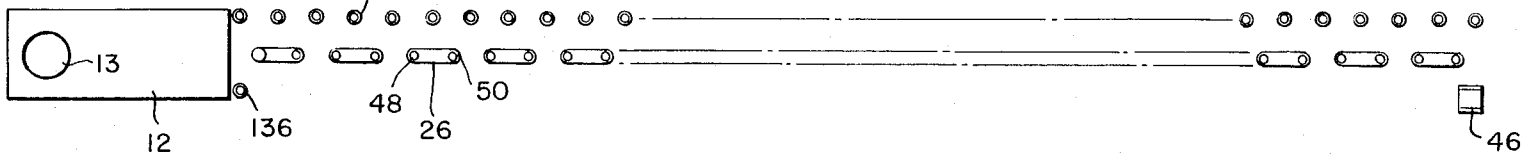
FIG. 4 is aplan view of the invention showing the fifth level assembly of lower brace chords.
Figure 5:
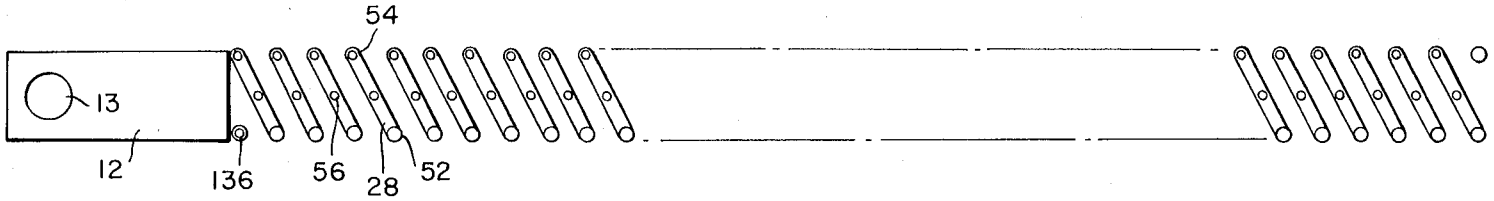
FIG. 5 is a plan view of the invention showing the fourth level assembly of diagonal brace components.
Figure 6:
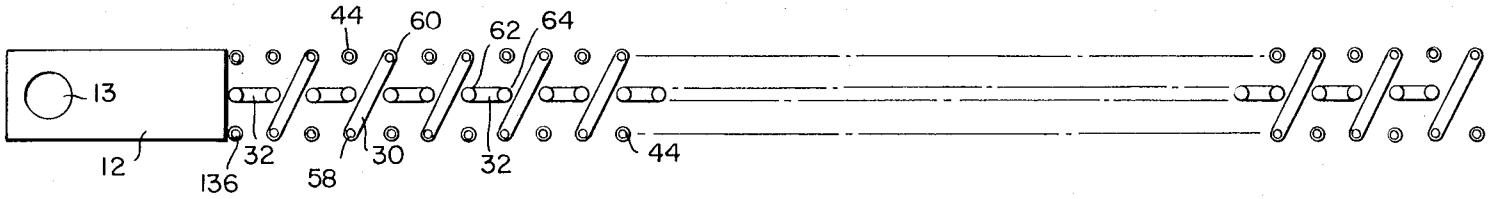
FIG. 6 is a plan view of the invention showing the third level assembly of long chords, diagonal braces and spacers for separating the components.
Figure 7:
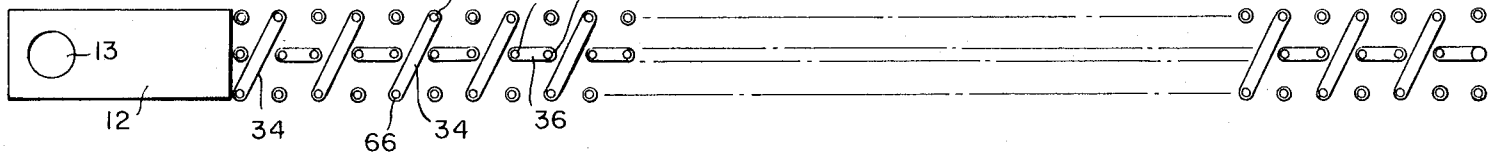
FIG. 7 is a plan view of the invention showing the second level assembly of long chords, diagonal braces and spacers.
Figure 8:
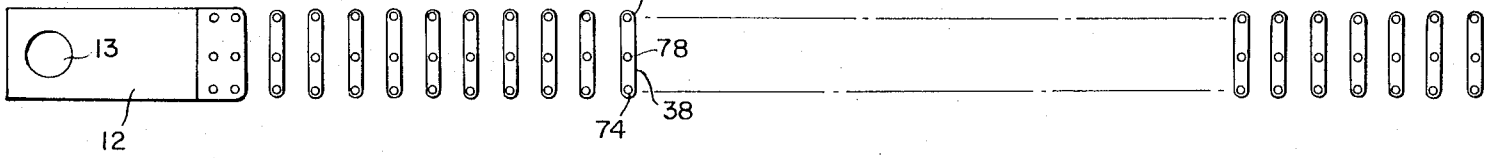
FIG. 8 is a plan view of the invention showing the lower level assembly of radial arms.
Figure 15:
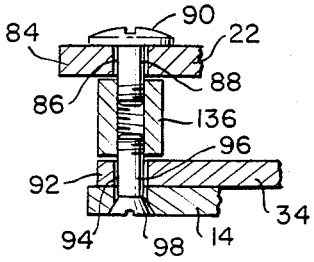
FIG. 15 is an elevated view of the instrument showing the connection of the fixed end of the bar scale to the diagonal brace and the tangent end radial arm.

FIG. 3 shows the sixth level brace chords 24 longitudinally aligned in spaced apart relationship. Apertures 40 and 42 extend through the brace chords for use with a pin assembly, to be described below. Ruling edge attachment dowels 106 are shown in FIG. 4 and are used in conjunction with front pin assembly, FIG. 13. A guideway 46 supports the free end of a bar scale 22, FIG. 4. The shank 88 of screw 90, FIG. 15, provides the pin about which the fixed end of the bar scale rotates. The next level of elements is shown in FIG. 4. This is the fifth level of brace chords 26 which have apertures 48 and 50 therein for receiving a pin assembly. The elements 24 and 26 overlap each other and are connected in such a fashion that they rotate and deflect relative to each other. The bar scale attachment dowel 136 receives the threaded end of shank 88, FIGS. 3 and 4. The fourth level of elements is shown in FIG. 5. The fourth level comprises diagonal braces 28 having apertures 52 and 54 therein near their ends thereof. A central aperture is shown at 56. The third level of elements is shown in FIG. 6. Third level comprises diagonal braces 30, which are oriented oppositely of the diagonal braces 28, having apertures 58 and 60 therein. Between the braces 30 and 34 is the third level of long chords 32 having apertures 62 and 64 therein. The second level of elements is shown in FIG. 7. The second level comprises diagonal braces 34 having apertures 66 and 68 therein. The braces 34 are parallel with but offset and below the braces 30. Between the braces 34 is the second level long chord elements 36 having apertures 70 and 72 therein for use with a pin assembly. The first level of elements is shown in FIG. 8. The first level of elements comprises the radial arms 38 having apertures 74 and 76 therein near the ends thereof and a central aperture 78 for use with a pin assembly.

In a typical instrument for engineering work, the long chords are in lengths of one half inches (½"). The ends of all of the elements are rounded to a radius equal to one half (½) their width. The rounding is very important along the ruling edge connection side so as to diminish the point of contact between the ruling edge and the elements. The elements are assembled by pin assemblies so that they override and overlap each other, FIGS. 2 and 9. The pin assembly connections to the lower and upper elements are flush with the surfaces of these elements so as to eliminate friction or protruding edges.

The assembly of elements will now be described in reference to FIG. 2 and FIGS. 9 through 15. The tangent end radial arm 14 is fastened to an end of the tangent bar 12 by suitable screws 80. An edge 82 of the radial bar 14 extends beyond the edge of the tangent bar 12. The end 84 of the bar scale 22 has an aperture 86 to receive the threaded end of shank 88 of a screw 90, FIG. 13. The threaded end of the shank 88 threads into a threaded bore of an attachment dowel 136. One end 92 of diagonal brace 34, FIG. 15, has an aperture 94 for receiving the threaded shank 96 of a screw 98 having a beveled head that seats in a countersunk bore in the end radial arm 14. The threaded end of the shank threads into the opposite threaded end of the attachment dowel 136. The bar scale 22 and the end of the diagonal brace 34 are fastened so that they rotate freely and independently from each other. Free rotation is assured by extending the shank portion of screws 90 and 98 slightly below bar scale 22 and above diagonal brace 34 respectively.

Figure 13:
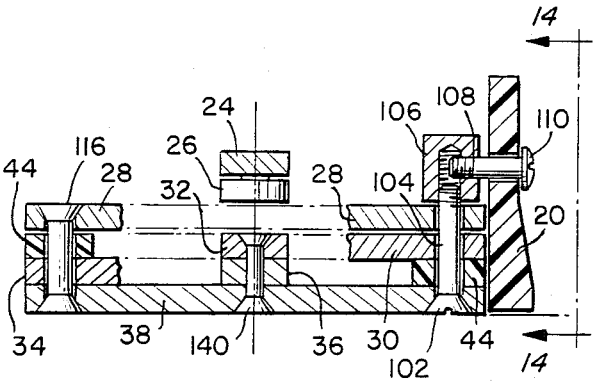
FIG. 13 is a sectional along the line 13—13 of FIG. 9 and shows details of the spacers and the connections of the radial arms, diagonal braces, long chords and ruling edge.
Figure 14:
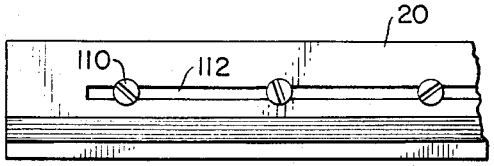
FIG. 14 is an elevational view of the ruling edge and is taken along the line 14—14 of FIG. 13.

The opposite ends of the second level diagonal braces 34 are connected to ends of the fourth level diagonal braces 28, and to spacers 44, as well as to the ends of radial arms 38 by a pin assembly 116 as shown in FIG. 13. The pin assembly in FIG. 13 shows a screw 102 having a smooth shank 104 with threaded end passing through apertures in the ends of the stacked elements and a spacer. Threaded dowels 106 are threaded onto the end of the screws so as to fasten the elements together for rotation independently of each other. The dowels 106 have lateral threaded bores for receiving the threaded ends 108 of screws 110 having a flat head and smooth shank of a length which will allow the rear face of the ruling edge 20 to just clear the stacked elements when tightly screwed into dowel 106. Manipulation of the curve will force the ruling edge to abut the rounded ends of the stacked elements. The smooth shank of the screw 110 passes through a slot 112 in the ruling edge 20, FIG. 14.

The front end of the fourth level diagonal brace 28 is fastened to the tangent end radial arm 14 by a pin and dowel assembly identical to that shown in FIG. 13. The opposite ends of the braces 28 are fastened to one end of a second or third level diagonal brace 34 and 30, and to an end of radial arm 38, as well as spacers 44 by a pin assembly 116, FIG. 13. This figure shows a countersunk aperture in the ends of the diagonal braces 28 and in the end of the radial arms 38. The countersunk apertures receive the beveled heads of suitable screws for seating in the countersunk bores. The pin assembly 116 of FIG. 13 is typical for connecting the diagonal braces and radial arms together for independent rotation of each other.

The second level long chords 36 and the third level long chords 32 overlap each other at the centers of the radial arms 38 and are fastened together by pin assembly 140, FIG. 13. The fifth level brace chord 26 and the sixth level brace chord 24 overlap each other at the centers of the fourth level diagonal braces 28 and are fastened together by pin assembly 142, FIG. 9.

Figure 11:
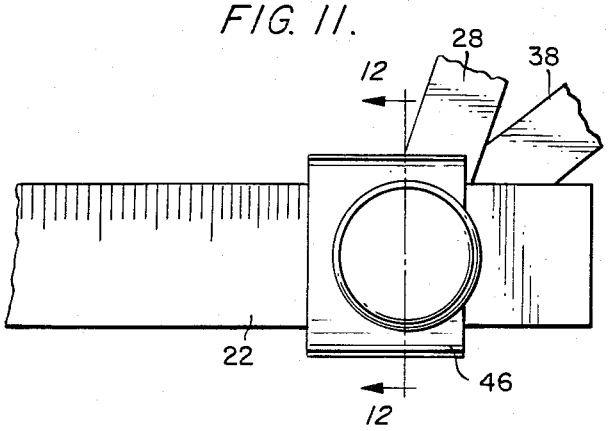
FIG. 11 is a plan view of the opposite end of the bar scale slidable through a guideway which is pivotably attached to a diagonal brace and a radial arm.
Figure 12:
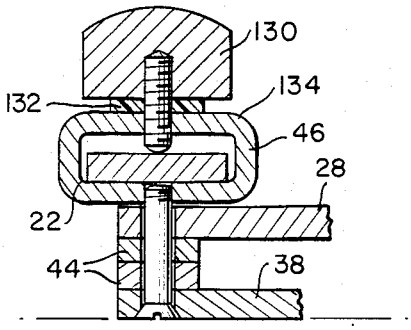
FIG. 12 is a side elevational view of the details of the bar scale guideway and connections to the diagonal brace and radial arm taken along the line 12–12 of FIG. 11.

FIGS. 11 and 12 are views showing the bar scale 22, guideway 46, fourth level diagonal brace 28 and the radial arm 38. A knurled screw 130 having a threaded shank 132 is turned into the top surface 134 of the guideway and bears against the top surface of the bar scale so as to secure the bar scale to the guideway. It is contemplated that the bar scale may be telescoped in nature whereby each end would be rigidly attached to the ends of the tool.

Alternatively, the bar scale may be removable by providing a locking device which would function to lock the ruling edge to a radial arm assembly.

Figure 16:
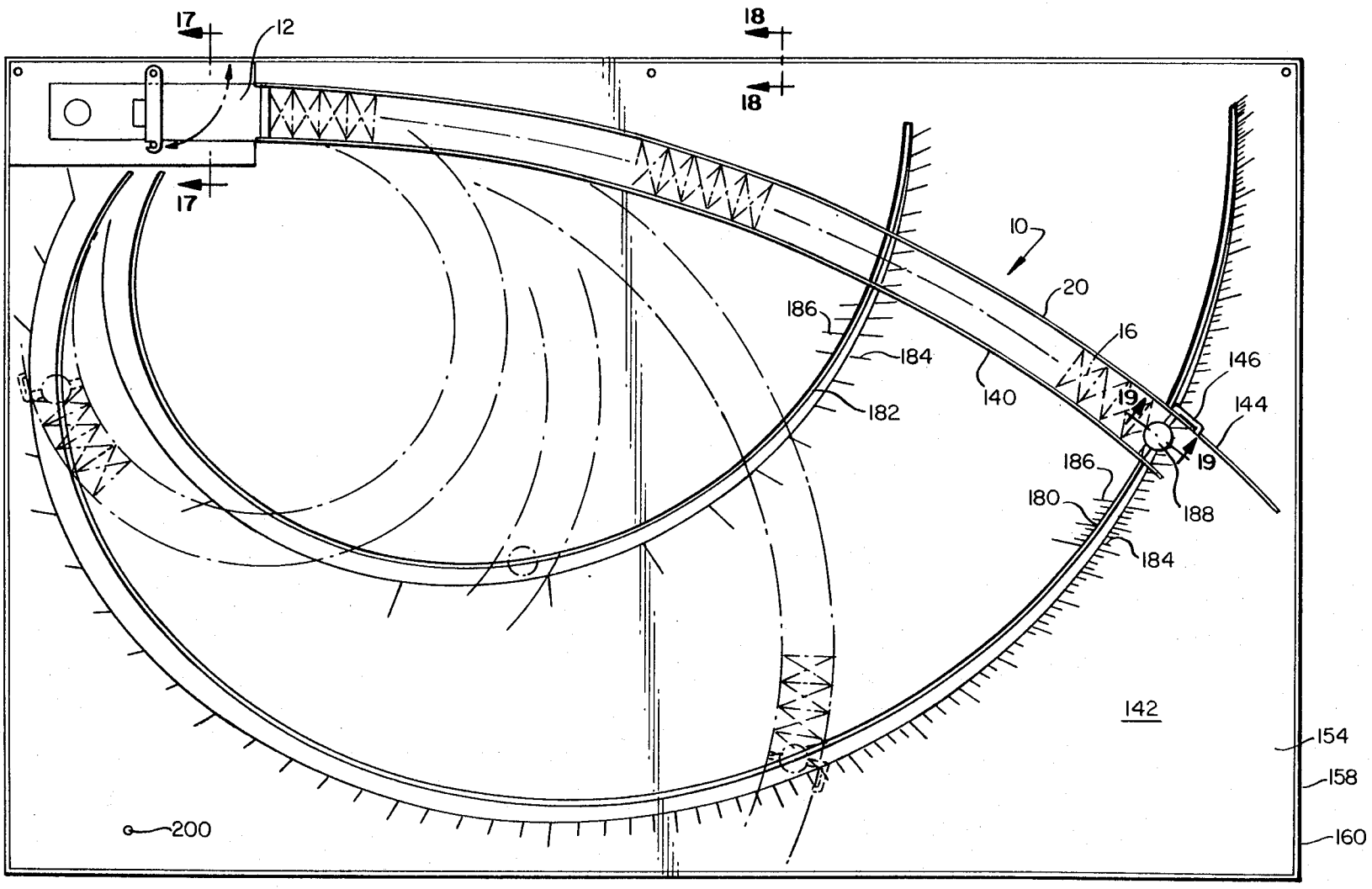
FIG. 16 is a plan view of a modified embodiment of the invention and shows the adjustable radial curve secured to a base at one end, the opposite end movable about a guideway on the base.

A modified form of the invention is shown in FIGS. 16 through 22. In FIG. 16 there is shown an adjustable radial curve having a support tangent bar 12, a plurality of stacked element 16 and convex ruling edge 20, all of which were previously described in detail. The modification resides in the addition of a second concave ruling edge 140 which will be described below and a base 142 for the instrument. The bar scale 22 is thus eliminated.

The ruling edge 140 is similar to ruling 20 and is attached to the tangent bar 12 by suitable means. The ruling edge 140 is attached to the stacked elements by a pin assembly identical to that of FIG. 13 and having a screw 102, shank 104 and dowel 106. The end 144 of the ruling edge 20 is releasably secured by a pin 146 to end radial arm assembly 148, FIG. 20. The shank 150 of the pin slides in slot 152 in the ruling edge 20. By tightening or freezing the ruling edge 20 to the assembly 148, an arc instructed with the instrument can be frozen at a desired radius.

Figure 18:
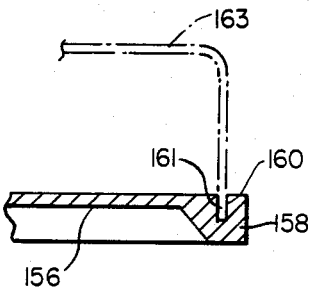
FIG. 18 is a view of a section of the base showing an edge thereof and a slot in the edge for receiving an edge of a transparent cover taken along the line 18—18 of figure.
Figure 19:
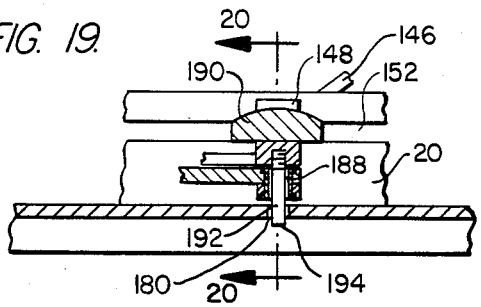
FIG. 19 is a cutaway view of the instrument taken along the line 19—19 of FIG. 16 and shows the base with slotted guideway and a guideway pin cooperating with the slotted guideway for routing the tool about the base.
Figure 20:
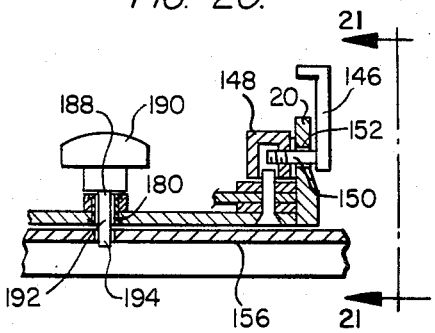
FIG. 20 is a view through line 20—20 of FIG. 19 and shows the base and guideway pin extending therethrough and a ruling edge with means to fasten same to the end radial arm assembly.
Figure 21:
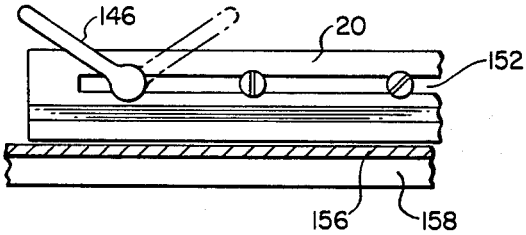
FIG. 21 is a view taken along the line 21—21 of FIG. 20 and shows the ruling edge fastening means.

The base 142 has a top flat surface 154, bottom surface 156, FIG. 18, and a block-like continuous bead or end 158 having a continuous slot 160 therein for the reception of a continuous edge 160 of a transparent top member 163 to be described below.

Figure 17:
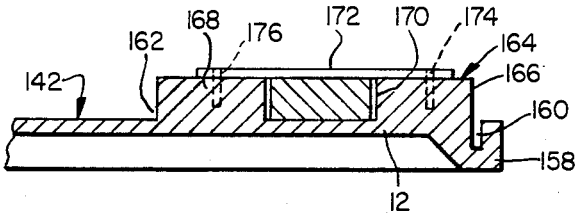
FIG. 17 is a view taken along the line 17—17 of FIG. 16 and shows a corner of the base having a raised portion of the base and a recess for receiving one end of the adjustable radial curve.

One corner 162, FIG. 17, of the base 142 has a raised portion 164 member having walls 166, 168 and a slot 170. The slot 170 snugly receives and supports the tangent bar 12. A latch 172 is pivoted to wall 166 by a pin 174 and is held in place over the tangent bar 12 by a latch pin mechanism 176. When the tangent bar 12 is in position in the slot 170 and secured by the pin 172, the entire tool is securely held on the base 142.

The base 142 has a plurality of slotted parabolic setting guideways 180, 182, each having convex ruling edge indicia markings 184 and concave ruling edge indicia markings 186. The indicia may indicate measurements in either inches or centimeters. Cooperating with the slot 180 or 182 is a pin 188, FIGS. 16, 19 and 20, having a head 190 and a shank 192, the end 194 of which rides in said slots. The shank 192 extends through bores in the end radial arm and long chord assembly. A pin similar to pin 188 is utilized with the slotted guideway 182 when an arc of smaller dimension is desired. Other slots may be incorporated in the base to accommodate for either smaller or larger arcs.

Figure 22:
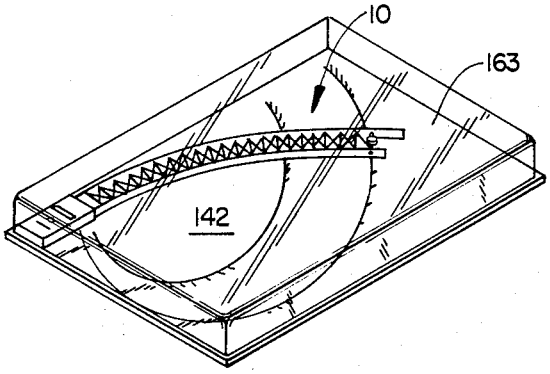
FIG. 22 is a plan view of the base, the instrument on the base and transparent cover.

FIG. 22 shows the instrument 10 secured to the base 142 and having a transparent cover 163, the bottom edge of which snaps into slot 160. The instrument is thus readily viewed while on display on a store shelf. The base is constructed from suitable material to provide a smooth, flat, inflexible surface for the instrument to glide or rotate upon. The base should also be thick enough to provide a slot or recess to receive the guideway pin. It is contemplated that a suitable durable plastic material may be utilized. The base will be of a dimension to accommodate the longest arc to be used. To this end, a number of guideway slots may be incorporated on the base. In this embodiment, two slots are shown.

Figure 9:
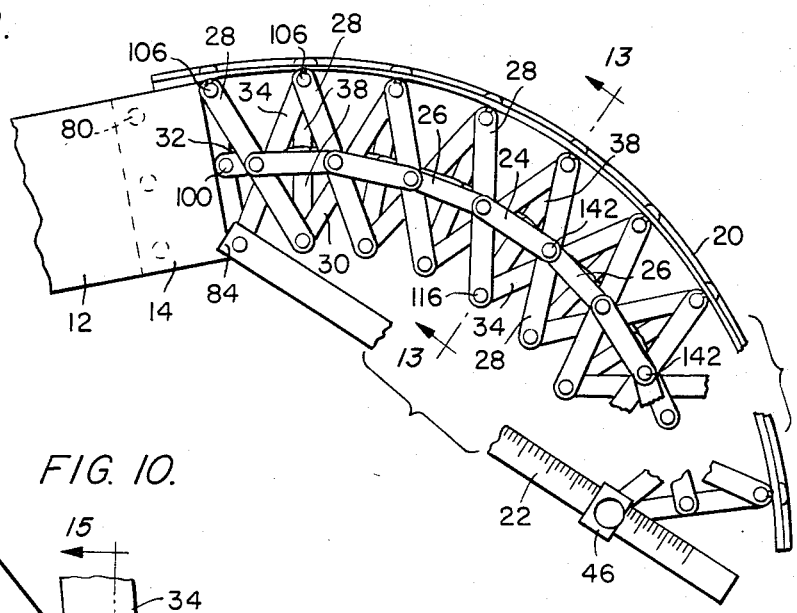
FIG. 9 is an enlarged plan view of the assembled invention showing the instrument in a partially curved position.
Figure 10:
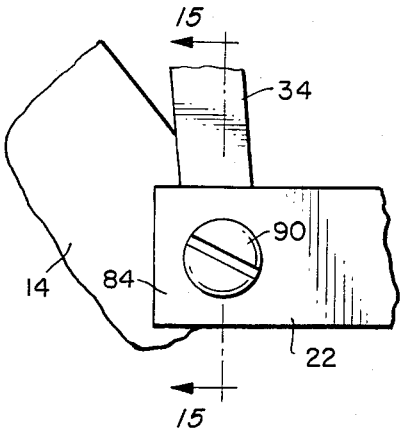
FIG. 10 is a plan view of the connection of one end of the bar scale to an end of a diagonal brace and the end tangent bar.

The parabolic guideway and scale together with cooperating guideway pin and the ruling edge locking pin provide a means for setting the instrument to a desired arc thus eliminating the bar scale 22 as seen in FIG. 9.

The parabolic guideway provides a geometric route for the adjustable radial curve instrument whereby the instrument may be set to form circles of given radius.

The principals of design of the parabolic guideway and the scale are determined from three knowns: (1) the overall length of the arc; (2) the length of the long chords; and (3) the total number of long chords used. Coordinate geometry, as well known in the art, is used in plotting the points of the guideway scale.

In operation, the tangent end 12 is secured in the slot 170 and the tool extended horizontally whereby the ruling edges are parallel. The pin 148 is inserted through the tool elements into the slotted guideway 180. A user may then rotate the adjustable radial curve along the slotted guideway 180 to a desired radius. The radius will then be read from the scale. The pin 146 is then tightened so that the ruling edge 20 is firmly secured to the end radial arm assembly 148. The guideway pin 188 may then be removed and secured in an aperture 200 by a snap fit or other latching mechanism. The tool may then be removed from the base and circles of that given radius constructed.

To set a radius for use with the lower concave ruling edge, it is only necessary to add one to the radius desired and then set that radius on the parabolic scale. There is no need for a separate scale for the concave ruling edge.

The important features of the embodiment shown in FIG. 16 through 22 are: (1) the provision of a base and storage means for the instrument; (2) the provision of means to secure the tangent bar to the base; (3) the provision of guideways on the base cooperating with a pin through the instrument for constructing arcs of various radii; (4) means for locking the ruling edge to the end radial arm assembly whereby an arc of given radius is set; (5) a permanent storing location for the guideway pin when the tool is in use in constructing curves; and (6) a transparent lid for the base whereby the tool may be displayed and viewed on store shelves.

It is to be noted that the base may be used in reverse. That is, if it is desired to determine the radius of a curved surface, the user would apply the instrument to the curved surface, freeze the instrument by the locking pin, and then place the tool on the base whereby the radius may be read from the scale.

While the invention has been shown and described in detail with reference to a preferred embodiment thereof, it will be understood to those skilled in the art to which this invention pertains that various changes in form and detail may be made therein without departing from the spirit and scope of the invention.

What I claim is:

1. An adjustable radial curve comprising:

a supporting bar;

a plurality of radial arms, long chords, diagonal braces and brace chords are fastened to each other and to the supporting bar a flexible ruling edge attached to said radial arms and diagonal braces; and a bar scale attached to one of said radial arms and one of said diagonal braces.

2. An adjustable radial curve comprising:

a supporting bar;

a plurality of radial arms;

a plurality of long chords attached at one end to the supporting bar and at the other ends to the radial arms;

a plurality of first diagonal braces attached at one end to the supporting bar and at the other ends to the radial arms;

a plurality of second diagonal braces attached at one end to the supporting bar and at the other ends to the radial arms;

a plurality of brace chords overlapping each other and attached to the second diagonal braches;

a ruling edge attached to the radial arms and the first and second diagonal braches; and a bar scale attached at one end to the supporting bar and at the other end to one of the the diagonal braces and one of the radial arms.

3. An adjustable radial curve as defined in claim 2, wherein:

said first and second diagonal braces overlapping each other.

4. An adjustable radial curve as defined in claim 2, wherein:

said first diagonal braces being spaced apart and parallel with each other yet staggered in different planes.

5. An adjustable radial curve as defined in claim 2, wherein:

said second diagonal braces being spaced apart and parallel with each other and oriented oppositely of the first diagonal braces.

6. An adjustable radial curve as defined in claim 2, wherein:

said long chords overlapping and attached to each other and to radial arms.

7. An adjustable radial curve as defined in claim 2, wherein:

said brace chords overlapping and attached to each other and to the second diagonal braces.

8. An adjustable radial curve as defined in claim 2, wherein:

said radial arms, long chords, diagonal braces, brace chords and supporting bar are constructed from plastic or metal or wood.

9. An adjustable radial curve as defined in claim 2, wherein:

said ruling edge is constructed from plastic or metal or wood.

10. An adjustable radial curve as defined in claim 2, wherein:

said radial arms and diagonal braces being attached to each other by means of dowels and pins.

11. An adjustable radial curve as defined in claim 10; and:

said dowel being a length slightly greater than the width of the combined radial arms, long chords, and first and second diagonal braces and brace chords it overlies.

12. An adjustable radial curve as defined in claim 10, wherein:

said dowels having a lateral threaded aperture for receiving a threaded end of a screw extending through a slot in the ruling edge whereby said ruling edge is attached to said dowels.

13. An adjustable radial curve as defined in claim 2, wherein:

said bar scale being rotatably attached at one end to the supporting bar and slidable through a guideway attached to the ends of a radial arm and a diagonal brace.

14. An adjustable radial curve as defined in claim 13; and:

said bar scale being secured in said guideway by a thumb screw.

15. An adjustable radial curve as defined in claim 13; and:

said guideway being metal.

16. An adjustable radial curve as defined in claim 2, wherein:

said plurality of radial arms, long chords, first and second diagonal braces, brace chords and supporting bar are secured together by pin assemblies whereby said radial arms, long chords, first and second diagonal braces, brace chords and supporting bar move freely and dependently with each other.

17. An adjustable radial curve as defined in claim 2, wherein:

said radial arms, long chords, first and second diagonal braces, and brace chords being rounded at their ends to a radius of one half their width whereby the surface area between said radial arms, long chords, first and second diagonal braces, brace chords and said ruling edge being minimal at the point of contact.

18. An adjustable radial curve as defined in claim 2, wherein:

said radial arms, long chords, and first and second diagonal braces and brace chords having spacers therebetween.

19. An adjustable radial curve as defined in claim 18; and:

said spacers having a diameter equal to the width of a stacked element.

20. An adjustable radial curve as defined in claim 2, wherein:

said radial arms, long chords, and first and second diagonal braces and brace chords being in six vertical levels.

21. An adjustable radial curve as defined in claim 20; wherein:

the first level being radial arms, the second level being long chords and diagonal braces, the third level being long chords and diagonal braces, the fourth level being diagonal braces, the fifth level being brace chords and the sixth level being brace chords.

* * * * *